US009750338B2

(12) United States Patent
Turner et al.

(10) Patent No.: US 9,750,338 B2
(45) Date of Patent: Sep. 5, 2017

(54) BLOW-MOLDED TABLE

(71) Applicant: Ameriwood Industries, Inc., Wright City, MO (US)

(72) Inventors: Dennis M Turner, Mooresville, IN (US); Andrew B Mendenhall, Mooresville, IN (US); Paul T Zink, Fishers, IN (US); Terrence C Bergin, Indianapolis, IN (US); Simon L Leclerc, Naperville, IL (US)

(73) Assignee: Dorel Home Furnishings, Inc., Wright City, MO (US)

( * ) Notice: Subject to any disclaimer, the term of this patent is extended or adjusted under 35 U.S.C. 154(b) by 0 days.

(21) Appl. No.: 15/041,254

(22) Filed: Feb. 11, 2016

(65) Prior Publication Data

US 2016/0227920 A1 Aug. 11, 2016

Related U.S. Application Data

(60) Provisional application No. 62/114,783, filed on Feb. 11, 2015.

(51) Int. Cl.
*A47B 3/083* (2006.01)
*A47B 3/08* (2006.01)

(52) U.S. Cl.
CPC ..... *A47B 3/0818* (2013.01); *A47B 3/083* (2013.01); *A47B 2003/0821* (2013.01); *A47B 2003/0827* (2013.01)

(58) Field of Classification Search
CPC .. A47B 3/0818; A47B 3/08; A47B 2003/0821
USPC ..... 108/127–133, 166–178
See application file for complete search history.

(56) References Cited

U.S. PATENT DOCUMENTS 1,827,373 A * 10/1931 Rosen ..... A47B 3/02 108/175
2,681,841 A * 6/1954 Sperry ..... A47B 3/083 108/129
2,921,825 A * 1/1960 Spiegel ..... A47B 3/0812 108/125
3,123,022 A * 3/1964 Huddleston ..... A47B 3/0818 108/129
3,368,504 A * 2/1968 Cohen ..... A47B 3/087 108/131
3,661,100 A * 5/1972 Tennant ..... A47B 3/0917 108/132
4,392,437 A * 7/1983 Wallace ..... A47B 3/00 108/129
4,841,877 A * 6/1989 Virtue ..... A47B 3/0912 108/167

(Continued)

FOREIGN PATENT DOCUMENTS

CN 202820137 U 3/2013
JP 2002223858 A 8/2002

OTHER PUBLICATIONS

PCT International Search Report and Written Opinion completed by the ISA/RU on May 10, 2016 and issued in connection with PCT/US2016/017496.

*Primary Examiner* — Daniel J Troy
*Assistant Examiner* — Timothy M Ayres
(74) *Attorney, Agent, or Firm* — Barnes & Thornburg LLP

(57) ABSTRACT

A folding table includes a table top provided with a table top elevator having legs. A hinge unit is coupled between panels of the table top to allow the table to be folded.

13 Claims, 5 Drawing Sheets

(56) References Cited

U.S. PATENT DOCUMENTS

| | | | | |
|---|---|---|---|---|
| 5,357,872 | A * | 10/1994 | Wilmore | A47B 3/087 108/132 |
| 5,943,965 | A | 8/1999 | Riach et al. | |
| 6,334,400 | B1 | 1/2002 | Nien | |
| 6,752,091 | B2 | 6/2004 | Glover et al. | |
| 6,779,466 | B2 | 8/2004 | Shabram, Jr. | |
| 6,920,832 | B2 | 7/2005 | Lou-Hao | |
| 7,278,361 | B2 | 10/2007 | Zhurong et al. | |
| 7,299,753 | B2 * | 11/2007 | Strong | A47B 3/083 108/115 |
| 7,337,728 | B2 | 3/2008 | Shabram, Jr. et al. | |
| 7,461,601 | B2 | 12/2008 | Jin et al. | |
| 7,475,641 | B2 | 1/2009 | Jin | |
| 7,634,969 | B2 | 12/2009 | Neunzert et al. | |
| 7,640,870 | B2 | 1/2010 | Strong et al. | |
| 7,703,402 | B2 | 4/2010 | Larcom et al. | |
| 7,707,948 | B2 | 5/2010 | Lin | |
| 7,707,949 | B2 | 5/2010 | Larcom et al. | |
| 7,735,431 | B2 | 6/2010 | Neunzert et al. | |
| 7,752,982 | B2 | 7/2010 | Lin | |
| 7,757,617 | B2 | 7/2010 | Larcom et al. | |
| 7,922,245 | B1 | 4/2011 | Sawhney | |
| 8,132,517 | B2 | 3/2012 | Leng | |
| 8,156,875 | B2 | 4/2012 | Neunzert et al. | |
| 8,371,646 | B1 | 2/2013 | Sawhney | |
| 8,388,055 | B1 | 3/2013 | Sawhney | |
| 8,397,653 | B2 | 3/2013 | Ashby et al. | |
| 8,408,640 | B1 | 4/2013 | Sawhney | |
| 8,573,139 | B2 | 11/2013 | Ashby et al. | |
| 8,651,031 | B1 * | 2/2014 | Pazhoor | E04H 1/1255 108/115 |
| 8,677,912 | B1 | 3/2014 | Tsai | |
| 8,726,817 | B2 | 5/2014 | Bennett et al. | |
| 8,881,661 | B2 | 11/2014 | Tsai | |
| 2014/0115827 | A1 | 5/2014 | Tsai | |
| 2014/0116301 | A1 | 5/2014 | Tsai | |
| 2014/0208992 | A1 | 7/2014 | Cai et al. | |
| 2014/0345505 | A1 | 11/2014 | Bennett et al. | |
| 2014/0345506 | A1 | 11/2014 | Clegg et al. | |
| 2015/0144036 | A1 | 5/2015 | Peery et al. | |

* cited by examiner

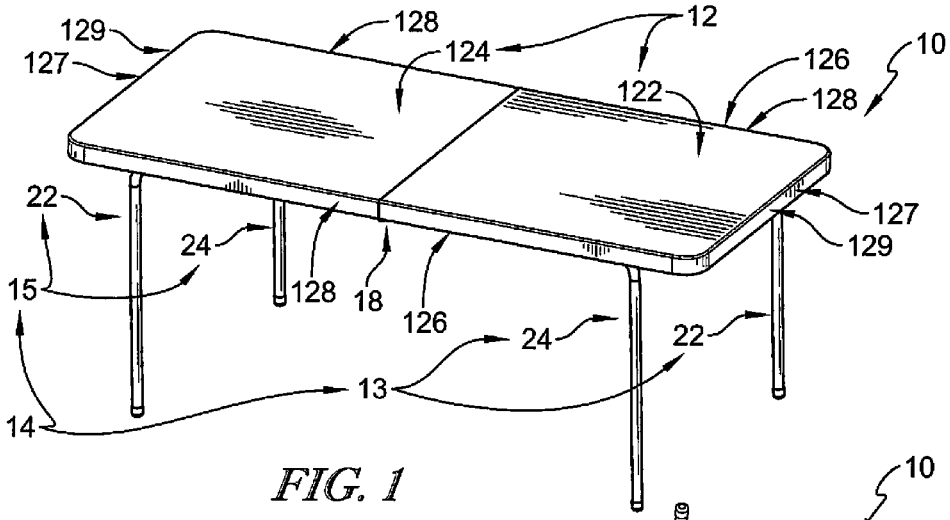
FIG. 1
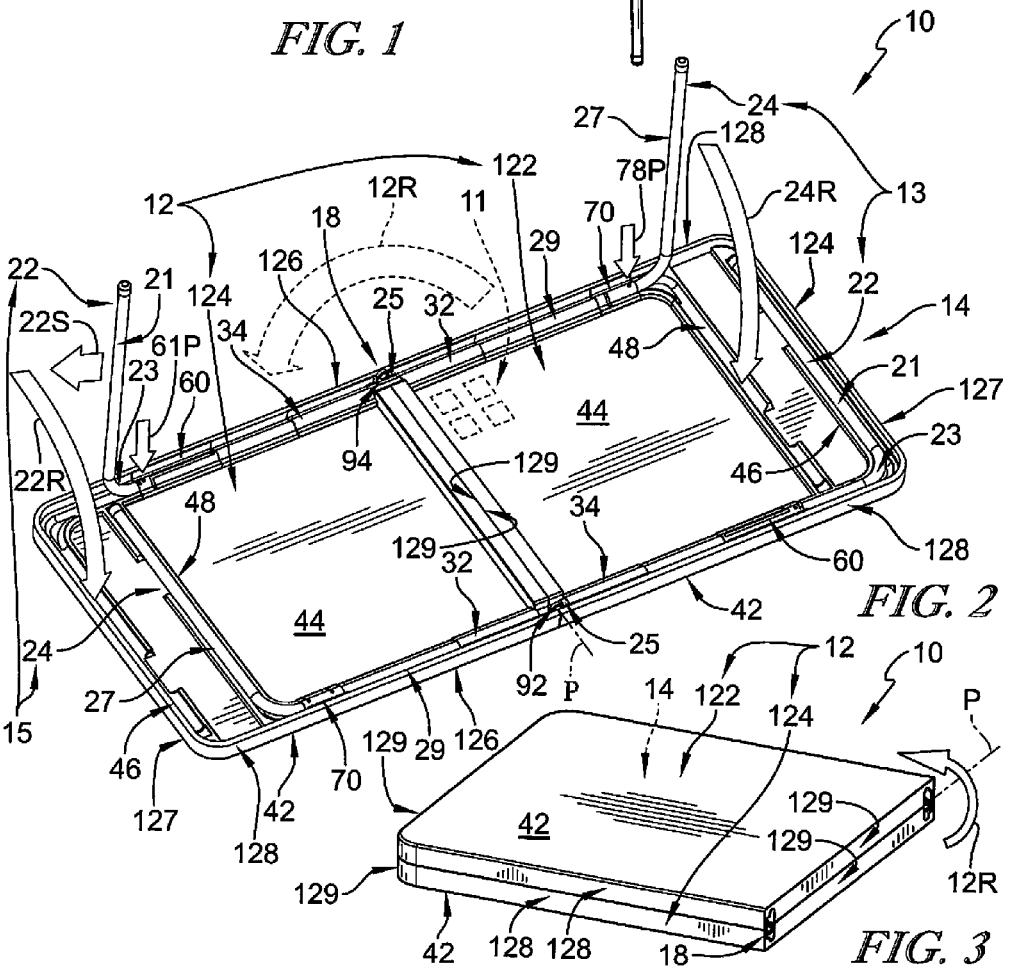
FIG. 2
FIG. 3

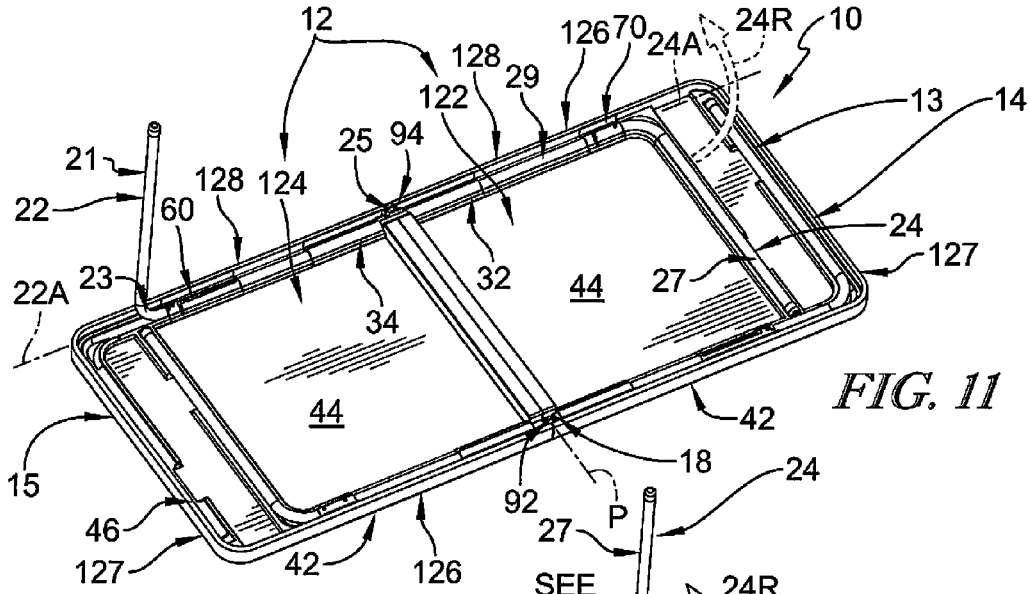
FIG. 11
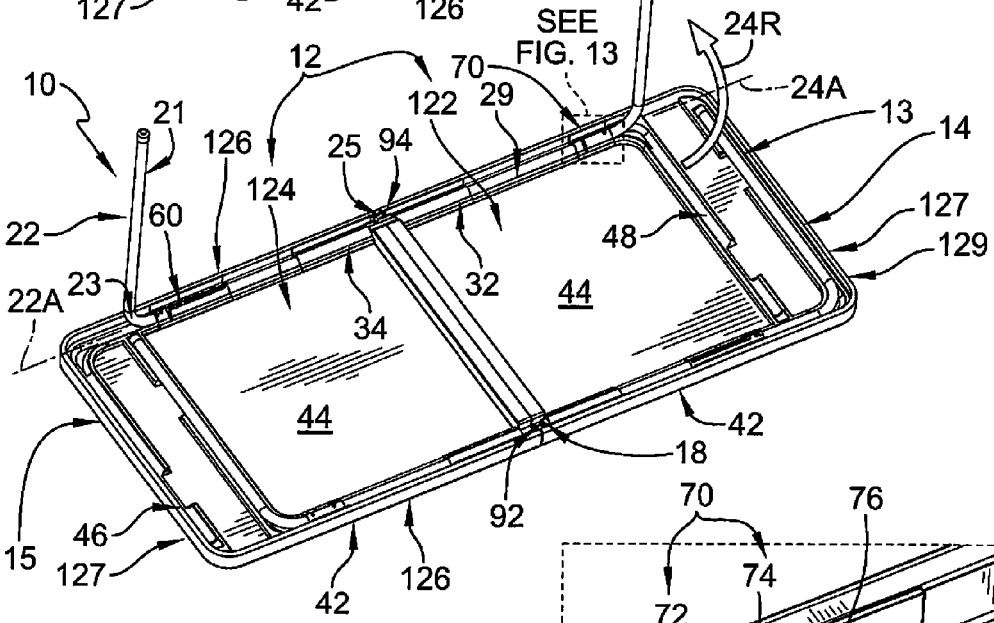
FIG. 12
FIG. 13

BLOW-MOLDED TABLE

CROSS REFERENCE TO RELATED APPLICATIONS

This application claims priority to and the benefit of U.S. Provisional Patent Application No. 62/114,783, filed 11 Feb. 2015, the disclosure of which is now expressly incorporated herein by reference.

BACKGROUND

The present disclosure relates to folding tables, and particularly to folding tables having blow-molded table tops. More particularly, the present disclosure relates to a locking unit to block folding of a blow-molded table.

SUMMARY

A folding table in accordance with the present disclosure includes a table top having a first panel and a second panel and a hinge unit connecting the first panel to the second panel. The hinge unit is adapted to allow rotation of the first panel of the table top relative to the second panel between an expanded-use position and a collapsed-storage position. The folding table further includes a table top elevator adapted to support the table top above ground level.

In illustrative embodiments, the table top elevator is adapted to hold the table top in the expanded-use position by blocking rotation of the first panel relative to the second panel of the table top. The table top elevator includes a first leg unit coupled to the first panel of the table top and a second leg unit coupled to the second panel. The first and second leg units each include a support leg and a table-locker leg. The support legs are each movable from a stowed position arranged to extend along the table top to a support position arranged to extend away from the table top. The table-locker legs are movable from an unlocked position arranged to extend along the table top and under only one of the first panel and second panel to a locked position arranged to extend away from the table top. In the locked position, the table locker legs extend under both the first panel and the second panel to block rotation of the first and second panel relative to one another. Accordingly, each table-locker leg provides lock means for holding the table top in the expanded-use position when in the locked position so that the table top is held in place during use of the folding table.

In illustrative embodiments, the folding table further includes leg-slider guides adapted to block the table-locker legs from pivoting relative to the table top when the table-locker legs are in the locked position. The leg-slider guides allow pivoting of the table-locker legs when the table locker legs are in the unlocked position. The leg-slider guides may each include a guide track formed through a cover plate coupled the table top and a slide pin coupled to the table-locker leg and positioned to travel within the guide track.

In illustrative embodiments, the folding table further includes pivot blockers positioned to block the table-locker legs from pivoting relative to the table top when in the locked position. The pivot blockers each include a blocker bar coupled to the table-locker leg and a bar-receiving channel formed in the table top and positioned to receive the blocker bar to engage with the blocker bar to block pivoting movement of the table-locker leg.

In illustrative embodiments, the folding table further includes pivot guides adapted to block sliding movement of the support legs relative to the table top while allowing the support legs to pivot relative to the table top. The pivot guides each include a guide slot formed through a guide plate coupled to the table top and a guide pin coupled to the support leg and positioned to travel in the guide slot.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a top perspective view of a folding table in accordance with the present disclosure showing that the folding table includes a table top, a hinge unit coupled between left-side and right-side panels of the table top, and a table top elevator positioned to support the table top in an expanded-use position;

FIG. 2 is a bottom perspective view of the folding table of FIG. 1 showing that the table top elevator includes table-locker legs adapted to slide and pivot from a locked position extending under both panels of the table top across a joint between the two panels of the table top to hold the table top in the expanded-use position and an unlocked position extending under one panel of the table top to allow the table top panels to pivot relative to one another about a pivot axis toward a collapsed-storage position as suggested in FIG. 3;

FIG. 3 is a top perspective view of the folding table of FIG. 1 showing the folding table in the collapsed-storage position and suggesting that the table top elevator is stored between the panels of the table top when the folding table is in the collapsed-storage position;

FIG. 11 is a view similar to FIG. 4 showing a support leg of the table top elevator in a stowed position extending along one of the panels of the table top and suggesting that a pivot section of the support leg is coupled along an edge of the table top to allow the support leg to pivot from the stowed position to a support position as shown in FIG. 12;

FIG. 12 is a view similar to FIG. 11 showing the support leg in the support position after pivoting relative to the table top and suggesting that a leg section of the table-locker leg and the support leg cooperate to support the table top when in the locked and support positions; and FIG. 13 is an enlarged view of FIG. 12 showing that a pivot guide adapted to control motion of the support leg includes a guide pin coupled to the support leg which moves in a guide slot to allow pivoting movement of the support leg relative to the table top while blocking sliding movement of the support leg.

DETAILED DESCRIPTION

Figure 4:
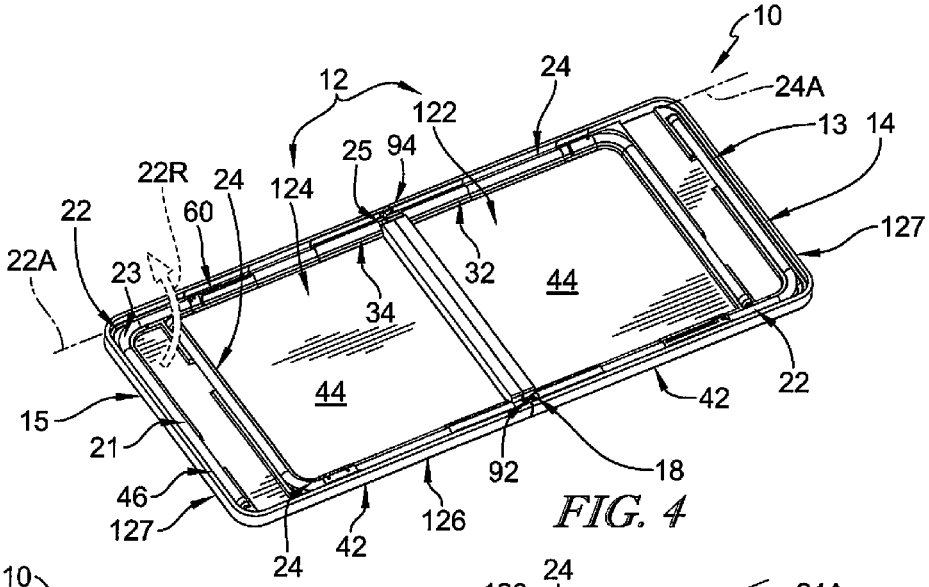
FIG. 4 is bottom perspective view of the folding table of FIG. 1 showing the table top in an unfolded position with the table-locker leg in the unlocked position extending along one of the panels of the table top and suggesting that a pivot section of the table-locker leg is coupled along an edge of the table top to allow the table-locker leg to pivot from the unlocked position to an extended position as shown in FIG. 5.

A folding table 10 in accordance with the present disclosure includes a table top 12 and a table top elevator 14 coupled to table top 12 for supporting table top 12 above a ground level as shown in FIG. 1. Table top 12 includes a right-side panel 122 and a left-side panel 124 coupled to right-side panel 122 by a hinge unit 18 for rotation about a pivot axis P between an expanded-use position, shown in FIG. 1, and a collapsed-storage position, shown in FIG. 3, where right-side panel 122 and left-side panel 124 are folded toward one another about the pivot axis P. Table top elevator 14 includes legs 22, 24 that support table top 12 above a ground level and that provide means for holding table top 12 in the expanded use position by extending under both right-side and left-side panels 122, 124 of table top 12 to block movement about pivot axis P so that table top 12 is maintained in place when folding table 10 is being used as suggested in FIGS. 2, 7, and 8.

Table top 12 is illustratively shaped to form a rectangle with opposing long sides 126 and short sides 127 as shown in FIG. 1. Table top 12 includes right-side panel 122 and left-side panel 124 that each form a rectangular shape with opposing long sides 128 and short sides 129. In some embodiments, right-side panel 122 and left-side panel 124 are formed by blow-molding a plastic material into the panels 122, 124. In some embodiments, weld cones 11, illustratively shown as squares in phantom in FIG. 2, are formed into an underside 44 and optionally engaged with a top side 42 of each panel 122, 124 during the blow-molding process.

Table top elevator 14 includes a right-side leg unit 13 coupled to right-side panel 122 of table top 12 and a left-side leg unit 15 coupled to left-side panel 124 as suggested in FIGS. 1 and 2. Right-side panel 122 and a left-side panel 124 of table top 12 each include a top side 42 positioned to support items placed on folding table 10 and an under side 44 as shown in FIG. 2. Right-side leg unit 13 is coupled to under side 44 of right-side panel 122 and left-side leg unit 15 is coupled to under side 44 of left-side panel 124. Right-side leg unit 13 and left-side leg unit 15 each include a table-locker leg 22 (sometimes called active leg 22) and a support leg 24 (sometimes called passive leg 24).

Figure 7:
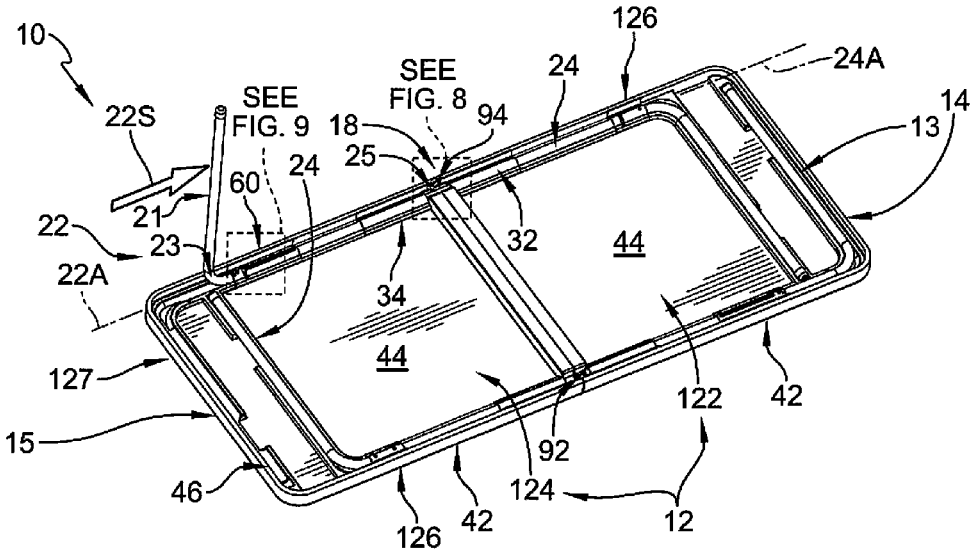
FIG. 7 is a view similar to FIG. 5 showing the table-locker leg in the locked position after sliding relative to the table top.
Figure 8:
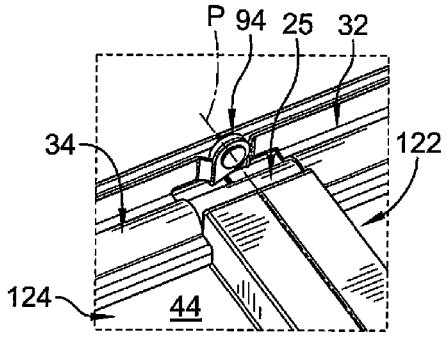
FIG. 8 is an enlarged view of FIG. 7 showing the lock section of the table-locker leg positioned across the pivot axis of the table top when the table-locker leg is in the locked position to block the panels of the table top from pivoting relative to one another.

Each table-locker leg 22 is pivotable and slidable relative to table top 12 as suggested in FIG. 2. Table-locker legs 22 are configured to move between an unlocked position, as shown in FIG. 4, and a locked position, as shown in FIG. 7. Table-locker legs 22 are configured to block movement of the panels 122, 124 from the expanded-use position to the collapsed-storage position when in the locked position. Table-locker legs 22 are configured to allow movement of the panels 122, 124 of the table top 12 between the collapsed-storage position and the expanded use position when in the unlocked position. Accordingly, table-locker legs 22 provide means for holding the table top 12 in the expanded-use position so that the table top is maintained in the expanded-use position during use of the folding table 10.

Each table-locker leg 22 includes a leg section 21, a pivot section 23 coupled to leg section 21, and a lock section 25 coupled to pivot section 23 as suggested in FIG. 2. Leg section 21 is configured to support table top 12. Pivot section 23 is coupled along an edge of table top 12 and configured to allow rotation of table-locker leg 22. Lock section 25 extends along the edge of table top 12 and is received in blocker brackets 32, 34 when table-locker leg 22 is in the locked position as suggested in FIG. 8. Blocker brackets 32, 34 are coupled to undersides 44 of panels 122, 124 and receive table-locker legs 22 to block movement of table top 12 from the expanded-use position to the collapsed storage position. In some embodiments, blocker brackets 32, 34 are integral with panels 122, 124.

Figure 6:
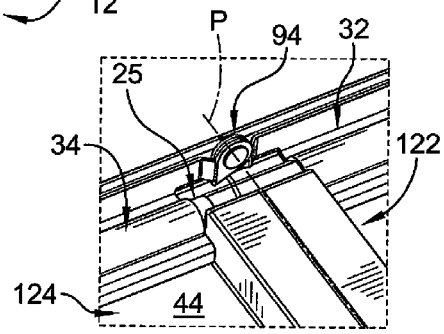
FIG. 6 is an enlarged view of FIG. 5 showing a lock section of the table-locker leg positioned to one side of a pivot axis of the table top when the table-locker leg is in the unlocked position to allow the panels of the table top to pivot relative to one another.

In the unlocked position, lock section 25 of table-locker leg 22 is positioned under one of panels 122, 124 of table top 12 and to one side of pivot axis P as suggested in FIG. 6. In the locked position, lock section 25 of table-locker leg 22 is positioned under both of panels 122, 124 of table top 12 and across pivot axis P as suggested in FIG. 8. In the illustrative embodiment, lock section 25 is received between blocker brackets 32, 34 and table top 12 when table-locker leg 22 is in the locked position.

Figure 9:
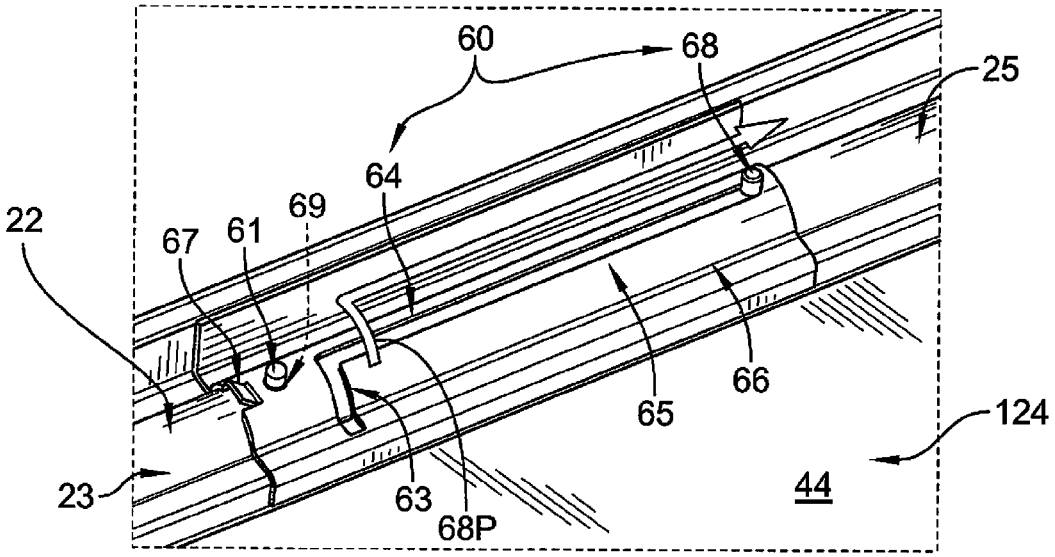
FIG. 9 is an enlarged view of FIG. 7 showing that a leg-slider guide adapted to control motion of the table-locker legs includes a guide track formed through a cover plate attached to the table top and a slide pin coupled to the pivot section of the table-locker leg which moves in the guide track to allow the table-locker leg to pivot relative to the table top when the slide pin travels in a pivot portion of the guide track and slide relative to the table top while block pivoting movement when the slide pin travels in a slide portion of the guide track.

A leg-slider guide 60 is positioned to guide movement of table-locker legs 22 relative to table top 12 as suggested in FIGS. 2 and 9. Leg-slider guide 60 includes a guide track 64 formed through a cover plate 66 (sometimes called bracket 66) coupled to under sides 44 and a slide pin 68 coupled to table-locker leg 22 as shown in FIG. 9. Slide pin 68 is configured to travel within guide track 64 to control motion of table-locker leg 22. Guide track 64 includes a pivot portion 63 and a slide portion 65. Pivot portion 63 is configured to allow table-locker legs 22 to pivot relative to table top 12 and block sliding movement while slide pin 68 is traveling within pivot portion 63. Slide portion 65 is configured to allow table-locker legs 22 to slide relative to table top 12 and block pivoting movement while slide pin 68 is traveling within slide portion 65. Cover plate 66 cooperates with table top 12 to form a locker-leg passageway that supports table-locker leg 22 for rotation and sliding about/along a locker-leg axis 22A.

Table-locker leg 22 also includes a position-locator pin 61 for holding table-locker leg 22 in the locked position at the selection of a user as suggested in FIG. 9. In some embodiments, position-locator pin 61 is a spring-loaded VALCO pin. Position-locator pin 61 engages a pin hole 69 formed through a cover plate 66 coupled to under side 44 to block sliding movement of table-locker leg 22. A pin ramp 67 is formed by cover plate 66 depresses position-locator pin 61 as table-locker leg 22 slides from the unlocked position to the locked position to allow position-locator pin 61 to travel beneath cover plate 66 to pin hole 69. A user disengages position-locator pin 61 from engagement with pin hole 69 by depressing position-locator pin 61 as suggested by arrow 61P in FIG. 2 to allow table-locker leg 22 to slide from the locked position to the unlocked position.

Figure 10:
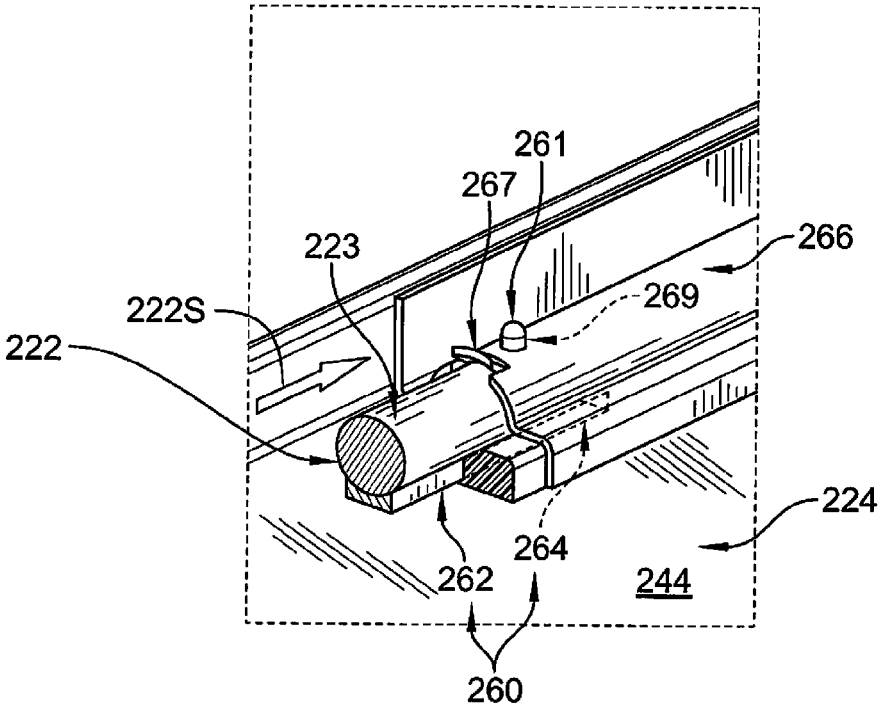
FIG. 10 is a partial cross-sectional view of another embodiment of a folding table in accordance with the present disclosure showing a pivot blocker adapted to block pivoting of a table-locker leg when in a locked position includes a blocker bar coupled to the table-locker leg of a table top elevator which passes into a bar-receiving channel formed in a table top to block pivoting movement of the table-locker leg relative to the table top and suggesting that a position-locator pin blocks sliding movement of the table locker leg.

Another embodiment of a table-locker leg 222 is shown in FIG. 10. A pivot blocker 260 is positioned to block table-locker leg 222 from pivoting relative to a table top panel 224 when table-locker leg 222 is in a locked position. Pivot blocker 260 includes a blocker bar 262 (sometimes called block 262) coupled to a pivot section 223 of table-locker leg 222 and a bar-receiving channel 264 (sometimes called pocket or track 264) formed in an under side 244 of panels 224 and positioned to receive blocker bar 262 to block table-locker leg 222 from pivoting. Table-locker leg 222 also includes a position-locator pin 261 for retaining table-locker leg 222 in the locked position. In some embodiments, position-locator pin 261 is a spring-loaded VALCO pin. Position-locator pin 261 engages a pin hole 269 formed through a cover plate 266 coupled to under side 244 to block sliding movement of table-locker leg 222 at the selection of a user. A pin ramp 267 formed by cover plate 266 depresses position-locator pin 261 to allow table-locker leg 222 to slide from an unlocked position to the locked position. A user disengages position-locator pin 261 from engagement with pin hole 269 by depressing position-locator pin 261 to allow table-locker leg 222 to slide from the locked position to the unlocked position.

Each support leg 24 is pivotable relative to table top 12 between a support position, associated with the expanded-use position, and a stowed position associated with the collapsed-storage position as suggested in FIGS. 11 and 12. Each support leg includes a leg section 27 and a pivot section 29 coupled to leg section 27. Leg section 27 is configured to support table top 12. Pivot section 29 is coupled along an edge of table top 12 and configured to allow rotation of support leg 24 relative to table top 12. A pivot guide 70 blocks sliding movement of support leg 24 relative to table top 12 while allowing support leg 24 to pivot relative to table top 12 at the selection of a user.

Pivot guide 70 includes a guide slot 72 and a guide pin 74 (sometimes called tracking pin 74) configured to travel in guide slot 72 as suggested in FIG. 13. Guide slot 72 is formed through a guide plate 76 (sometimes called bracket 76) coupled to under side 44. Guide pin 74 is coupled to pivot section 29 of support leg 24 and travels within guide slot 72 to control movement of support leg 24. Each support leg 24 also includes a lock pin 78 coupled to pivot section 29 and positioned to engage a pin hole 79 formed through guide plate 76 to block rotation of support leg 24 from the support position to the stowed position at the selection of a user. In some embodiments, lock pin 78 is a VALCO pin. A user disengages lock pin 78 from pin hole 79 by depressing lock pin 78 as suggested by arrow 78P in FIG. 1 to allow support leg 24 to rotate from the support position to the stowed position. Guide plate 76 cooperates with table top 12 to form a support-leg passageway that receives support leg 24 and supports support leg 24 for rotation about support-leg axis 24A.

In the illustrative embodiment, table-locker leg 22 and support leg 24 are L-shaped as shown in FIG. 2. As such, leg sections 21, 27 provide vertical support to table top 12 and pivot sections 23, 29 and lock sections 25 provide horizontal support to table top 12. In some embodiments, table-locker legs 22 and support legs 24 are formed from bent metal tubing.

Each under side 44 of right-side and left-side panels 122, 124 is formed to include a locker-leg receiver 46 positioned to receive leg section 21 of table-locker leg 22 and a support-leg receiver 48 positioned to receive leg section 27 of support leg 24 as suggested in FIG. 2. Table-locker leg 22 slides relative to table top 12 from the locked position to the unlocked position and leg section 21 pivots relative to table top 12 to be received in locker-leg receiver 46. Support leg 24 pivots from the support position to the stowed position such that leg section 27 is received in support-leg receiver 48.

Hinge unit 18 includes a right-side hinge 92 and a left-side hinge 94 coupled between blocker brackets 32, 34 on opposing edges of table top 12 as shown in FIG. 2. In some embodiments, right-side hinge 92 and left-side hinge 94 are formed from stamped metal pieces with a pin extending through the pieces. One end of the pin may be welded to one piece and an opposing end of the pin may be deformed to block the pieces from separating. Hinges 92, 94 are substantially aligned along pivot axis P to allow rotation of panels 122, 124 of table top 12 relative to one another.

In the collapsed-storage position, right-side and left-side panels 122, 124 are rotated about pivot axis P such that under sides 44 are in confronting relation as suggested in FIG. 3. Table-locker legs 22 are in the unlocked position and leg sections 21 are positioned in locker-leg receivers 46. Similarly, support legs 24 are in the stowed position and leg sections 27 are positioned in support-leg receivers 48. Table top elevator 14 is trapped between panels 122, 124 when table top 12 is in the collapsed-storage position as suggested in FIG. 3. In the expanded-use position, right-side and left-side panels 122, 124 are rotated about pivot axis P such that right-side and left-side panels 122, 124 are positioned in substantially the same plane as suggested in FIG. 1. Table-locker legs 22 are in the locked position and lock sections 25 extend across pivot axis P to block rotation of panels 122, 124. Similarly, support legs 24 are in the support position.

Figure 5:
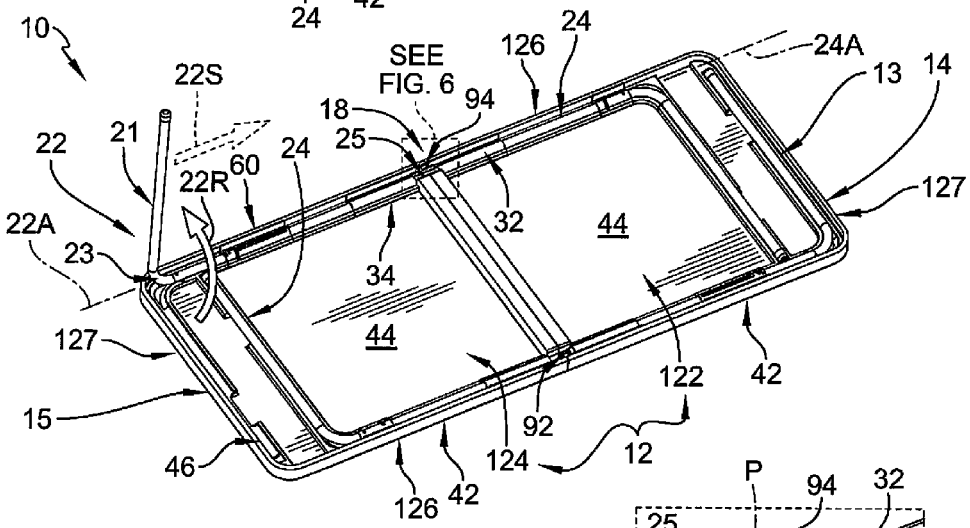
FIG. 5 is a view similar to FIG. 4 showing the table-locker leg in the extended position after pivoting relative to the table top and suggesting that moving the table-locker leg to the extended position allows the table-locker leg to slide relative to the table top to a locked position as shown in FIG. 7.

After unfolding table top 12, a user pivots leg section 21 of table-locker leg 22 relative to table top 12 as suggested by arrow 22R in FIGS. 4 and 5. A user slides table-locker leg 22 relative to table top 12 such that lock section 25 extends across pivot axis P as suggested by arrow 22S in FIGS. 7 and 8. A user pivots leg section 27 of support leg 24 relative to table top 12 as suggested by arrow 22R in FIGS. 11 and 12. The table-locker legs 22 and support legs 24 of both leg units 13, 15 are moved in this way. A user does the reverse to allow table top 12 to move to the collapsed-storage position.

In illustrative embodiments, table-locker legs 22 and support legs 24 do not interlock with one another. Table-locker leg 22 is coupled to table top 12 by cover plate 66 and blocker bracket 34 coupled to under side 44. In some embodiments, cover plate 66 and blocker bracket 34 attach to table top 12 via an interlock and lock screw. Blocker bar 62 may be formed by injection molding and attach to table-locker leg 22 to engage with bar-receiving channel 64 molded into table top 12 to prevent rotation of the L-shaped leg when table top 12 is in the expanded-use position.

In illustrative embodiments, right-side and left-side hinges 92, 94 may be single or other type of stamped piece of steel and welded to blocker brackets 32, 34. Right-side and left-side panels 122, 124 may each be formed to include a molded in support structure running along pivot axis P to provide added support in a central portion of table top 12 while in the expanded-use position.

In illustrative embodiments, an active leg 22 rotates upward relative to the table top 12 and then slides across the middle of the table top 12 to lock the table 10 in an open position. The active leg 22 locks in position using a VALCO pin. A passive leg 24 rotates upward relative to the table top 12 and locks in place with a VALCO pin 78. A tracking pin 74 blocks the passive leg 24 from sliding. Stamped and welded hinges 92, 94 connect the table top halves 122, 124 together.

In illustrative embodiments, an injection molded block 262 attached to the active leg 222 engages with a pocket 264 formed in the table top 212 to maximize strength.

The invention claimed is:

1. A folding table comprising a table top including a first panel and a second panel, a hinge unit coupling the first panel of the table top to the second panel of the table top for movement about a table axis from a collapsed-storage position arranged along an underside of the first panel to an expanded-use position arranged adjacent to a side of the first panel, and a table top elevator adapted to support the table top above ground level when the table top is in the expanded-use position, the table top elevator including a first leg unit coupled to the first panel of the table top and a second leg unit coupled to the second panel, each of the first and second leg units including a support leg rotatable about a support-leg axis from a stowed position arranged to extend along the table top to a support position arranged to extend away from the table top and a table-locker leg linearly movable from an unlocked position arranged to extend along the table top and under an underside of only one of the first panel and the second panel to a locked position arranged to extend away from the table top and under undersides of both the first panel and the second panel to block rotation of the second panel relative to the first panel such that the table-locker legs included in the first and the second leg units provide lock means for holding the table top in the expanded-use position when the table-locker legs are in the locked position so that the table top is maintained in place during use of the folding table, and further comprising pivot guides positioned to block sliding movement of the support legs relative to the table top while allowing the support legs to pivot relative to the table top, the pivot guides each including a guide slot formed through a guide plate coupled to the table top and a guide pin coupled to the support leg and positioned to travel in the guide slot, and wherein the support legs and the table-locker legs are each configured to support the table top in the expanded-use position.

2. A folding table comprising a table top including a first panel and a second panel, a hinge unit coupling the first panel of the table top to the second panel of the table top for movement about a table axis from a collapsed-storage position arranged along an underside of the first panel to an expanded-use position arranged adjacent to a side of the first panel, and a table top elevator adapted to support the table top above ground level when the table top is in the expanded-use position, the table top elevator including a first leg unit coupled to the first panel of the table top and a second leg unit coupled to the second panel, each of the first and second leg units including a support leg rotatable about a support-leg axis from a stowed position arranged to extend along the table top to a support position arranged to extend away from the table top and a table-locker leg linearly movable from an unlocked position arranged to extend along the table top and under an underside of only one of the first panel and the second panel to a locked position arranged to extend away from the table top and under undersides of both the first panel and the second panel to block rotation of the second panel relative to the first panel such that the table-locker legs included in the first and the second leg units provide lock means for holding the table top in the expanded-use position when the table-locker legs are in the locked position so that the table top is maintained in place during use of the folding table, and wherein the table-locker legs each include a leg section and a lock section coupled to the leg section and wherein the leg section is mounted to the table top to pivot relative to the table top about a locker-leg axis defined by the lock section, and wherein the support legs and the table-locker legs are each configured to support the table top in the expanded-use position.

3. A folding table comprising a table top including a first panel and a second panel, a hinge unit coupling the first panel of the table top to the second panel of the table top for movement about a table axis from a collapsed-storage position arranged along an underside of the first panel to an expanded-use position arranged adjacent to a side of the first panel, and a table top elevator adapted to support the table top above ground level when the table top is in the expanded-use position, the table top elevator including a first leg unit coupled to the first panel of the table top and a second leg unit coupled to the second panel, each of the first and second leg units including a support leg rotatable about a support-leg axis from a stowed position arranged to extend along the table top to a support position arranged to extend away from the table top and a table-locker leg movable from an unlocked position arranged to extend along the table top and under an underside of only one of the first panel and the second panel to a locked position arranged to extend away from the table top and under undersides of both the first panel and the second panel to block rotation of the second panel relative to the first panel such that the table-locker legs included in the first and the second leg units provide lock means for holding the table top in the expanded-use position when the table-locker legs are in the locked position so that the table top is maintained in place during use of the folding table, wherein the table-locker legs each include a leg section and a lock section coupled to the leg section and wherein the leg section is mounted to the table top to pivot relative to the table top about a locker-leg axis defined by the lock section, and wherein the lock sections of the table-locker legs extend under one of the first panel and second panel when the table-locker legs are in the unlocked position and wherein the lock sections of the table-locker legs extend under both the first panel and the second panel of the table top to block rotation of the first and second panel relative to one another when the table-locker legs are in the lock position, and wherein the support legs and the table-locker legs are each configured to support the table top in the expanded-use position.

4. A folding table comprising a table top including a first panel and a second panel, a hinge unit coupling the first panel of the table top to the second panel of the table top for movement about a table axis from a collapsed-storage position arranged along an underside of the first panel to an expanded-use position arranged adjacent to a side of the first panel, and a table top elevator adapted to support the table top above ground level when the table top is in the expanded-use position, the table top elevator including a first leg unit coupled to the first panel of the table top and a second leg unit coupled to the second panel, each of the first and second leg units including a support leg rotatable about a support-leg axis from a stowed position arranged to extend along the table top to a support position arranged to extend away from the table top and a table-locker leg movable from an unlocked position arranged to extend along the table top and under an underside of only one of the first panel and the second panel to a locked position arranged to extend away from the table top and under undersides of both the first panel and the second panel to block rotation of the second panel relative to the first panel such that the table-locker legs included in the first and the second leg units provide lock means for holding the table top in the expanded-use position when the table-locker legs are in the locked position so that the table top is maintained in place during use of the folding table, wherein the table-locker legs each include a leg section and a lock section coupled to the leg section and wherein the leg section is mounted to the table top to pivot relative to the table top about a locker-leg axis defined by the lock section, and wherein the hinge unit includes a first hinge coupled along an edge of the table top between the first and second panels and a second hinge coupled to an edge of the table top opposite the first hinge and between the first and second panels, each of the first and second hinges including a first bracket and a second bracket coupled to the first bracket for rotation relative to the first bracket, and wherein the support legs and the table-locker legs are each configured to support the table top in the expanded-use position.

5. The folding table of claim 4, wherein the lock sections of the table-locker legs extend between the first and second panels of the table top and the first and second brackets of one of the first and second hinges when the table-locker legs are in the locked position to block rotation of the first and second panel of the table top relative to one another.

6. A folding table comprising a table top including a first panel and a second panel mounted for rotation about a table axis relative to the first panel from a collapsed-storage position arranged along an underside of the first panel to an expanded-use position arranged adjacent to a side of the first panel, a support leg mounted to rotate about a support-leg axis from a stowed position arranged to extend along the table top to a support position arranged to extend away from the table top, a table-locker leg mounted to rotate about a locker-leg axis from an unlocked position arranged to extend along the table top to an extended position arranged to extend away from the table top and to slide linearly along the locker-leg axis from the extended position arranged under an underside of only one of the first and the second panels to a locked position arranged at least partially under at least a portion of undersides of both the first panel and the second panel to block rotation of the second panel of the table top relative to the first panel of the table top when the table top is in the expanded-use position, wherein the table-locker leg includes a leg section that extends away from the table top when the table-locker leg is in the locked position, a pivot section that extends along the locker-leg axis when the table-locker leg is in the locked position, and a lock section that extends from the pivot section along the locker-leg axis and that extends under at least a portion of both the first panel and the second panel when the table-locker leg is in the locked position, and wherein the table top is shaped to form a rectangle with opposing long sides and short sides that are shorter than the long sides, the locker-leg axis extends parallel to the long sides of the table top, and the leg section of the table-locker leg extends perpendicular to the locker-leg axis parallel to the short sides of the table top, and wherein the support legs and the table-locker legs are each configured to support the table top in the expanded-use position.

7. A folding table comprising a table top including a first panel and a second panel mounted for rotation about a table axis relative to the first panel from a collapsed-storage position arranged along an underside of the first panel to an expanded-use position arranged adjacent to a side of the first panel, a support leg mounted to rotate about a support-leg axis from a stowed position arranged to extend along the table top to a support position arranged to extend away from the table top, a table-locker leg mounted to rotate about a locker-leg axis from an unlocked position arranged to extend along the table top to an extended position arranged to extend away from the table top and to slide linearly along the locker-leg axis from the extended position arranged under an underside of only one of the first and the second panels to a locked position arranged at least partially under at least a portion of undersides of both the first panel and the second panel to block rotation of the second panel of the table top relative to the first panel of the table top when the table top is in the expanded-use position, wherein the table-locker leg includes a leg section that extends away from the table top when the table-locker leg is in the locked position, a pivot section that extends along the locker-leg axis when the table-locker leg is in the locked position, and a lock section that extends from the pivot section along the locker-leg axis and that extends under at least a portion of both the first panel and the second panel when the table-locker leg is in the locked position, and wherein the first panel of the table top is shaped to form a rectangle with opposing long sides and short sides that are shorter than the long sides, the locker-leg axis extends parallel to the long sides of the first panel, and the leg section of the table-locker leg extends perpendicular to the locker-leg axis parallel to the short sides of the first panel, and wherein the support legs and the table-locker legs are each configured to support the table top in the expanded-use position.

8. A folding table comprising a table top including a first panel and a second panel mounted for rotation about a table axis relative to the first panel from a collapsed-storage position arranged along an underside of the first panel to an expanded-use position arranged adjacent to a side of the first panel, a support leg mounted to rotate about a support-leg axis from a stowed position arranged to extend along the table top to a support position arranged to extend away from the table top, a table-locker leg mounted to rotate about a locker-leg axis from an unlocked position arranged to extend along the table top to an extended position arranged to extend away from the table top and to slide linearly along the locker-leg axis from the extended position arranged under an underside of only one of the first and the second panels to a locked position arranged at least partially under at least a portion of undersides of both the first panel and the second panel to block rotation of the second panel of the table top relative to the first panel of the table top when the table top is in the expanded-use position, wherein the table-locker leg includes a leg section that extends away from the table top when the table-locker leg is in the locked position, a pivot section that extends along the locker-leg axis when the table-locker leg is in the locked position, and a lock section that extends from the pivot section along the locker-leg axis and that extends under at least a portion of both the first panel and the second panel when the table-locker leg is in the locked position, and further comprising a cover plate coupled to the table top to define a locker leg receiving passageway that extends along the locker-leg axis and receives the pivot section of the table-locker leg, the locker leg receiving passageway sized to support the table-locker leg for rotation about the locker-leg axis and for sliding movement along the locker-leg axis, and wherein the support legs and the table-locker legs are each configured to support the table top in the expanded-use position.

9. A folding table comprising a table top including a first panel and a second panel mounted for rotation about a table axis relative to the first panel from a collapsed-storage position arranged along an underside of the first panel to an expanded-use position arranged adjacent to a side of the first panel, a support leg mounted to rotate about a support-leg axis from a stowed position arranged to extend along the table top to a support position arranged to extend away from the table top, and a table-locker leg mounted to rotate about a locker-leg axis from an unlocked position arranged to extend along the table top to an extended position arranged to extend away from the table top and to slide along the locker-leg axis from the extended position arranged under an underside of only one of the first and the second panels to a locked position arranged at least partially under at least a portion of undersides of both the first panel and the second panel to block rotation of the second panel of the table top relative to the first panel of the table top when the table top is in the expanded-use position, wherein the table-locker leg includes a leg section that extends away from the table top when the table-locker leg is in the locked position, a pivot section that extends along the locker-leg axis when the table-locker leg is in the locked position, and a lock section that extends from the pivot section along the locker-leg axis and that extends under at least a portion of both the first panel and the second panel when the table-locker leg is in the locked position, further comprising a cover plate coupled to the table top to define a locker leg receiving passageway that extends along the locker-leg axis and receives the pivot section of the table-locker leg, the locker leg receiving passageway sized to support the table-locker leg for rotation about the locker-leg axis and for sliding movement along the locker-leg axis, and wherein the cover plate is formed to include a guide track, the guide track receives a slide pin coupled to the table-locker leg for movement therewith, and the guide track is shaped to control rotation and sliding of the table-locker leg relative to the table top as the table-locker leg moves from the unlocked position to the locked position, and wherein the support legs and the table-locker legs are each configured to support the table top in the expanded-use position.

10. A folding table comprising a table top including a first panel and a second panel mounted for rotation about a table axis relative to the first panel from a collapsed-storage position arranged along an underside of the first panel to an expanded-use position arranged adjacent to a side of the first panel, a support leg mounted to rotate about a support-leg axis from a stowed position arranged to extend along the table top to a support position arranged to extend away from the table top, and a table-locker leg mounted to rotate about a locker-leg axis from an unlocked position arranged to extend along the table top to an extended position arranged to extend away from the table top and to slide along the locker-leg axis from the extended position arranged under an underside of only one of the first and the second panels to a locked position arranged at least partially under at least a portion of undersides of both the first panel and the second panel to block rotation of the second panel of the table top relative to the first panel of the table top when the table top is in the expanded-use position, wherein the table-locker leg includes a leg section that extends away from the table top when the table-locker leg is in the locked position, a pivot section that extends along the locker-leg axis when the table-locker leg is in the locked position, and a lock section that extends from the pivot section along the locker-leg axis and that extends under at least a portion of both the first panel and the second panel when the table-locker leg is in the locked position, further comprising a cover plate coupled to the table top to define a locker leg receiving passageway that extends along the locker-leg axis and receives the pivot section of the table-locker leg, the locker leg receiving passageway sized to support the table-locker leg for rotation about the locker-leg axis and for sliding movement along the locker-leg axis, and wherein the cover plate is formed to include a pin hole and the table-locker leg includes a spring-loaded position-locator pin that extends into the pin hole when the table locker leg is in the locked position to block movement of the table-locker leg away from the locked position, and wherein the support legs and the table-locker legs are each configured to support the table top in the expanded-use position.

11. The folding table of claim 10, wherein the cover plate is formed to include pin ramp shaped to depress the spring-loaded position-locator pin during movement of the table-locker leg from the unlocked position to the locked position.

12. The folding table of claim 9, further comprising a guide plate coupled to the table top to define a support leg receiving passageway that extends along the support-leg axis and receives a portion of the support leg, the support leg receiving passageway sized to support the support leg for rotation about the support-leg axis.

13. The folding table of claim 12, wherein the guide plate is formed to include a pin hole and a guide slot, the support leg includes a spring-loaded lock pin that extends into the pin hole when the support leg is in the support position to block movement of the support leg away from the support position, the guide slot is shaped to control rotation of the support leg relative to the table top as the support leg moves from the stowed position to the support position, and a guide pin coupled to the support leg for movement therewith is received in the guide slot.

* * * * *